US010953655B2

(12) United States Patent
Shimoyama

(10) Patent No.: US 10,953,655 B2
(45) Date of Patent: Mar. 23, 2021

(54) LIQUID EJECTION HEAD AND METHOD FOR PRODUCING THE SAME

(71) Applicant: CANON KABUSHIKI KAISHA, Tokyo (JP)

(72) Inventor: Hiroyuki Shimoyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/709,314

(22) Filed: Dec. 10, 2019

(65) Prior Publication Data

US 2020/0139702 A1 May 7, 2020

Related U.S. Application Data

(62) Division of application No. 15/814,704, filed on Nov. 16, 2017, now Pat. No. 10,562,301.

(30) Foreign Application Priority Data

Dec. 9, 2016 (JP) ..... JP2016-239368

(51) Int. Cl.
*B41J 2/14* (2006.01)
*B41J 2/16* (2006.01)
*B41J 2/055* (2006.01)

(52) U.S. Cl.
CPC ..... *B41J 2/14* (2013.01); *B41J 2/055* (2013.01); *B41J 2/14233* (2013.01); *B41J 2/16* (2013.01); *B41J 2/161* (2013.01); *B41J 2/1623* (2013.01); *B41J 2002/14419* (2013.01); *B41J 2002/14459* (2013.01)

(58) Field of Classification Search
CPC ... B41J 2/14; B41J 2/055; B41J 2/1623; B41J 2/161; B41J 2/14233; B41J 2/16; B41J 2002/14419; B41J 2002/14459
See application file for complete search history.

(56) References Cited

U.S. PATENT DOCUMENTS

2013/0257993 A1* 10/2013 Ono ..... B41J 2/055 347/54

FOREIGN PATENT DOCUMENTS

JP 2016-043576 A 4/2016

* cited by examiner

*Primary Examiner* — Henok D Legesse
(74) *Attorney, Agent, or Firm* — Venable LLP

(57) ABSTRACT

A liquid ejection head includes a laminated body including a first plate having a plurality of ejection nozzles for ejecting a liquid and made from a resin material and a second plate having a plurality of through-holes communicating with the corresponding ejection nozzles and made from a metal material. The laminated body has a plurality of projection parts formed along the array direction Y of the ejection nozzles and having a curved dome shape projecting in the direction from the second plate to the first plate. The second plate has a plurality of through-slits formed adjacent to the projection parts.

19 Claims, 9 Drawing Sheets

LIQUID EJECTION HEAD AND METHOD FOR PRODUCING THE SAME

CROSS-REFERENCE TO RELATED APPLICATIONS

This application is a divisional application of U.S. patent application Ser. No. 15/814,704, filed Nov. 16, 2017, which claims the benefit of Japanese Patent Application No. 2016-239368, filed Dec. 9, 2016. Both of these prior applications are hereby incorporated by reference herein in their entirety.

BACKGROUND OF THE INVENTION

Field of the Invention

The present invention relates to a liquid ejection head that ejects a liquid from ejection nozzles and a method for producing the liquid ejection head.

Description of the Related Art

In a liquid ejection head that ejects a liquid such as an ink from ejection nozzles to record images on recording media, a liquid-repellent film is formed on an ejection nozzle surface having the openings of the ejection nozzles to prevent a liquid from adhering to the periphery of the ejection nozzles in order to maintain stable ejection performance. However, the ejection nozzle surface placed to face a recording paper (recording medium) may be hit by the recording paper floated up by paper jam or the like, and this may damage the liquid-repellent film around the ejection nozzles. To address this problem, Japanese Patent Application Laid-Open No. 2016-43576 discloses a liquid ejection head that includes a plurality of projection parts on an ejection nozzle surface to prevent a recording paper from hitting and damaging a liquid-repellent film around ejection nozzles even when the recording paper is floated up by paper jam or the like. The projection parts are formed by the following procedure: a resin plate having ejection nozzles is joined to a metal plate having flow paths communicating with the ejection nozzles; the plates are subjected to press working; and the plates are curved and projected in the direction from the metal plate to the resin plate.

By the above production method, however, an internal stress generated during the press working can form a clearance between the plates, and into the clearance, water (moisture) can enter from the outside through the resin plate during subsequent production steps. When these two plates in such a condition are thermally joined to other plates included in the liquid ejection head, the water infiltrated into the clearance may expand to release the resin plate from the metal plate, unfortunately.

SUMMARY OF THE INVENTION

The present invention is intended to provide a liquid ejection head achieving high reliability by relaxing the internal stress generated at the time of production and a method for producing the liquid ejection head.

In order to achieve the object, a liquid ejection head of the present invention includes a laminated body including a first plate having a plurality of ejection nozzles configured to eject a liquid and made from a resin material and a second plate having a plurality of through-holes communicating with the corresponding ejection nozzles and made from a metal material. The laminated body has a plurality of projection parts formed along an array direction of the ejection nozzles and having a curved dome shape projecting in a direction from the second plate to the first plate, and the second plate has a plurality of through-slits formed adjacent to the projection parts.

A method for producing a liquid ejection head of the present invention, in which the liquid ejection head includes a laminated body including a first plate having a plurality of ejection nozzles configured to eject a liquid and made from a resin material and a second plate having a plurality of through-holes communicating with the corresponding ejection nozzles and made from a metal material, and the laminated body has a plurality of projection parts formed along an array direction of the ejection nozzles and having a curved dome shape projecting in a direction from the second plate to the first plate, includes a step of forming a plurality of through-slits in the second plate, a step, after the formation of the slits, of joining the first plate and the second plate to form the laminated body, and a step of curving and projecting the laminated body at positions adjacent to the through-slits in a direction from the second plate to the first plate to form the dome-shaped projection parts on the laminated body.

In such a liquid ejection head and a method for producing a liquid ejection head, a plurality of through-slits formed in a second plate can relax the internal stress generated during the formation of a plurality of projection parts on a laminated body including a first plate and the second plate.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention will now be described with reference to drawings.

In the present specification, a liquid ejection head that ejects an ink to record images on recording media will be described as an example of the liquid ejection head of the present invention. However, the present invention is not intended to be limited to the example, and is applicable to a liquid ejection head that ejects another liquid, for example, a liquid ejection head that ejects a conductive liquid to form a conductive pattern on a substrate surface. The liquid ejection head of the present invention is not limited to serial heads described in the following embodiments and is applicable to, for example, what is a called line head that is fixedly mounted in an apparatus main body and has a plurality of ejection nozzles arranged over the width direction of a recording medium.

First Embodiment

Figure 1:
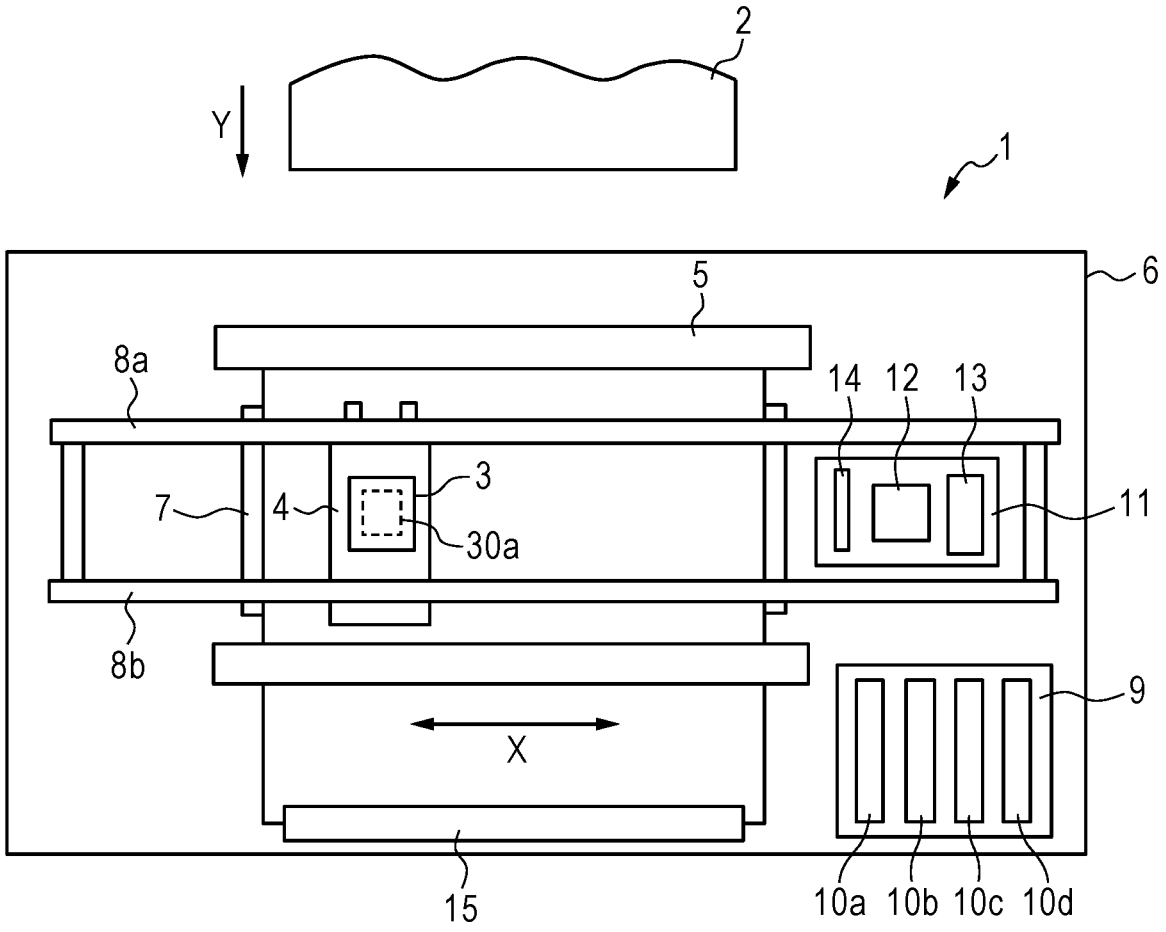
FIG. 1 is a schematic plan view of a recording apparatus including a liquid ejection head.

Before the description of the structure of a liquid ejection head pertaining to a first embodiment of the present invention, the structure of a recording apparatus to which the liquid ejection head of the embodiment is mounted will be described. FIG. 1 is a schematic plan view of an ink jet recording apparatus of the embodiment.

A recording apparatus 1 includes a liquid ejection head 3 configured to eject an ink to record an image on a recording paper (recording medium) 2, a carriage 4 capable of reciprocating along a scanning direction X, and a conveyance mechanism 5 configured to convey the recording paper 2 in a conveyance direction Y orthogonal to the scanning direction X. In a casing 6, a platen 7 supporting the recording paper 2 is provided along the horizontal direction, and above the platen 7, two guide rails 8*a*, 8*b* extending parallel to the scanning direction X are provided. The carriage 4 can be driven by a carriage drive motor (not shown) to move along the two guide rails 8*a*, 8*b* in the scanning direction X in a region facing the recording paper 2 on the platen 7.

The liquid ejection head 3 is attached to the carriage 4 while an ejection nozzle surface 30*a* having openings of a plurality of ejection nozzles for ejecting a liquid faces the platen 7, and can move together with the carriage 4 in the scanning direction X. The liquid ejection head 3 is connected to an ink cartridge holder 9 through tubes (not shown). The ink cartridge holder 9 is equipped with four ink cartridges 10*a*, 10*b*, 10*c*, 10*d* filled with black, yellow, cyan, and magenta inks, respectively, and these inks are supplied through the tubes to the liquid ejection head 3. While moving together with the carriage 4 in the scanning direction X, the liquid ejection head 3 can eject inks to the recording paper 2 that is conveyed by the conveyance mechanism 5 toward a paper discharge part 15 in the conveyance direction Y, thereby recording images, characters, and the like.

The recording apparatus 1 further includes a maintenance unit 11 that is placed outside the platen 7 in a moving region of the carriage 4. The maintenance unit 11 includes a cap 12, a suction pump 13, and a wiper 14, and the like. The cap 12 is configured to be driven up and down by a cap driving part (not shown) including a drive source such as a motor and a power transmission mechanism such as a gear. When the carriage 4 moves above the maintenance unit 11 while, for example, the liquid ejection head 3 is not used, the cap 12 is moved up by the cap driving part to come in close contact with the ejection nozzle surface 30*a* of the liquid ejection head 3, thereby performing capping. After the capping, the suction pump 13 connected to the cap 12 sucks the air in the cap 12 to reduce the pressure in the cap 12, thereby performing suction purge of forcedly discharging inks from the ejection nozzles of the liquid ejection head 3 into the cap 12. By the suction purge, bubbles or dust contained in an ink, an ink causing viscosity increase, or the like is discharged, and the liquid ejection performance is prevented from deteriorating. The wiper 14 is for wiping inks adhering to the ejection nozzle surface 30*a* of the liquid ejection head 3 when the liquid ejection head 3 moves to the liquid ejection position after suction purge.

Figure 2:
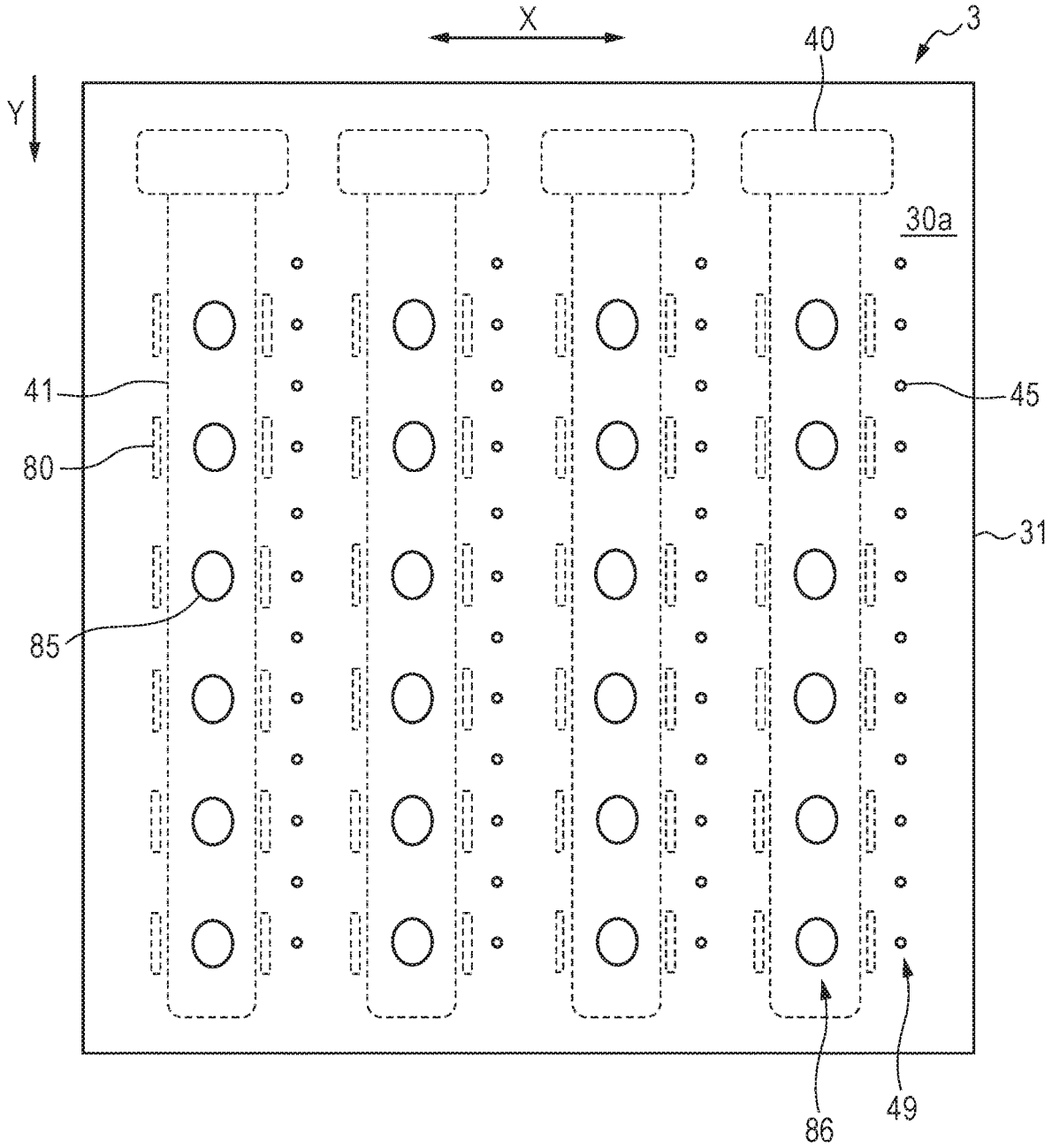
FIG. 2 is a schematic plan view of a liquid ejection head pertaining to a first embodiment.
Figure 3:
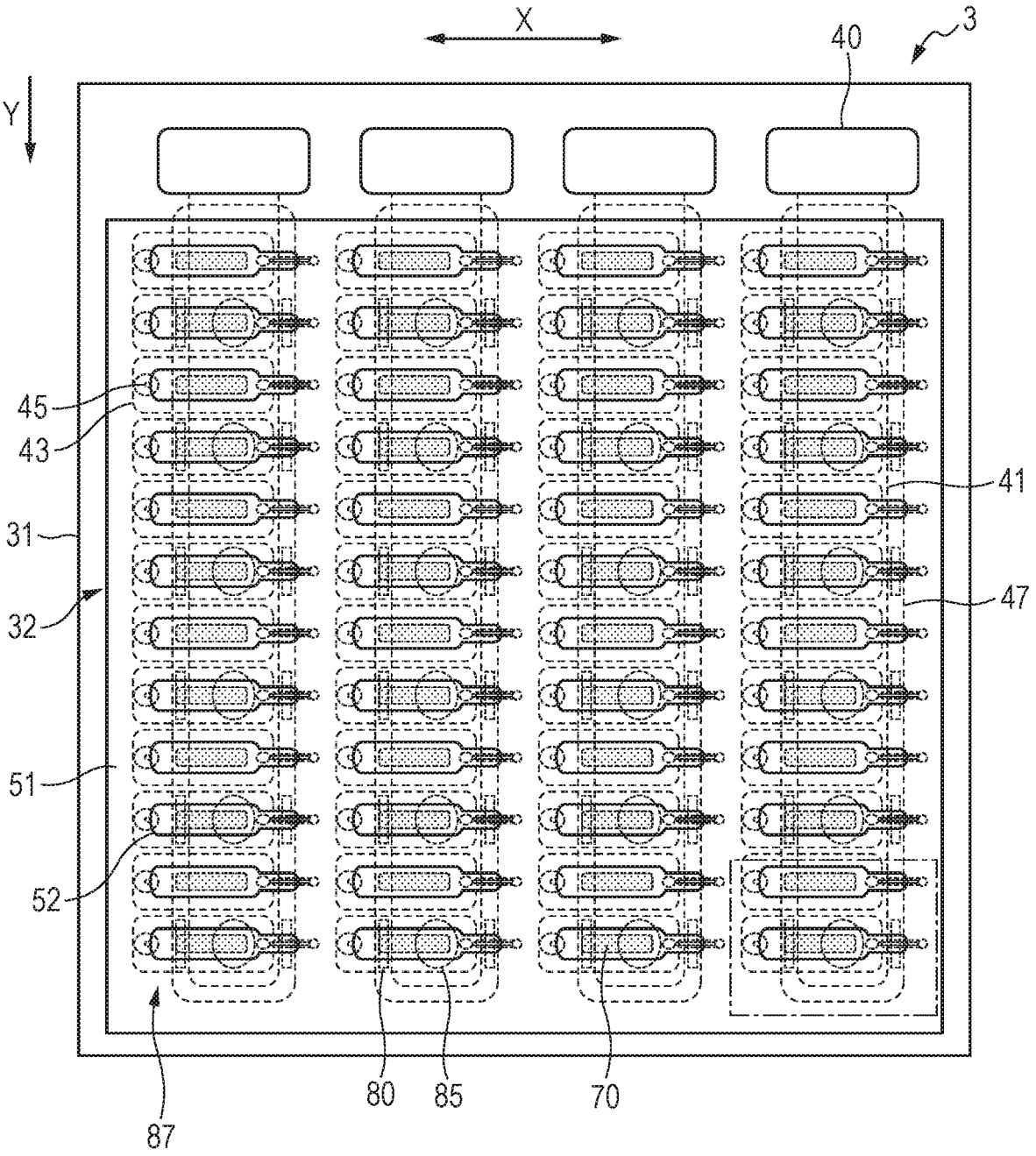
FIG. 3 is a schematic plan view of a liquid ejection head pertaining to the first embodiment.
Figure 4A:
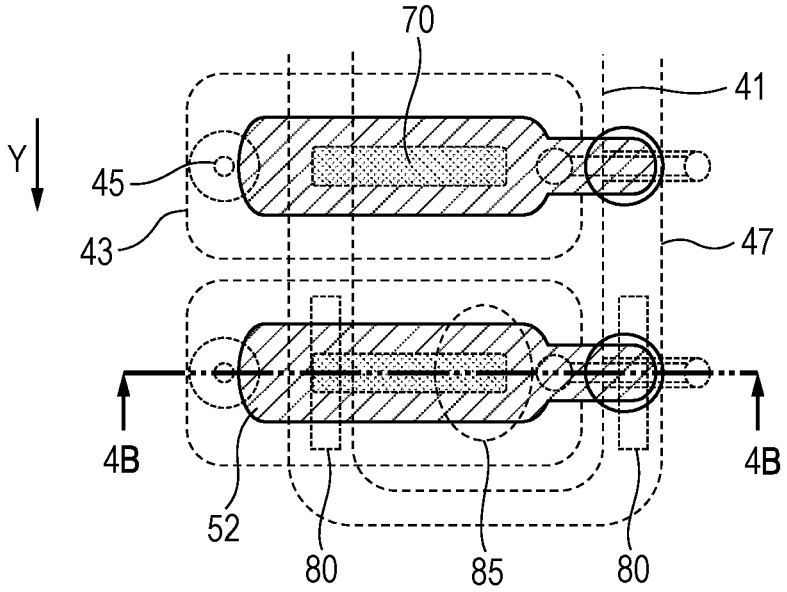
FIGS. 4A and 4B are an enlarged schematic plan view and a cross-sectional view of the liquid ejection head in FIG. 3.
Figure 4B:
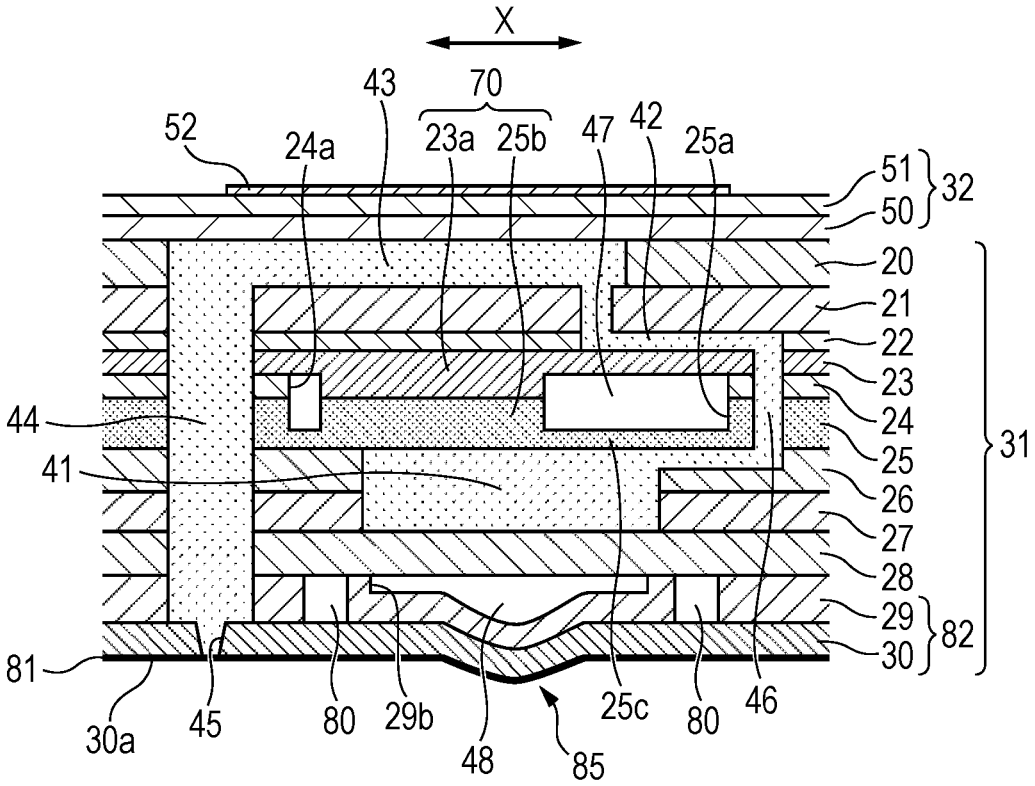

With reference to FIG. 2 to FIG. 4, the structure of a liquid ejection head of the embodiment will next be described. FIG. 2 is a schematic plan view of a liquid ejection head of the embodiment, viewed from the ejection nozzle surface side, and FIG. 3 is a schematic plan view, viewed from the opposite side. FIG. 4A is an enlarged schematic plan view of the region surrounded by the dot-dash line in FIG. 3, and FIG. 4B is a schematic cross-sectional view taken along line 4B-4B in FIG. 4A.

As shown in FIG. 2 to FIG. 4, a liquid ejection head 3 includes a flow path forming member 31 and a piezoelectric actuator 32 joined to the flow path forming member 31.

The flow path forming member 31 includes a plurality of ejection nozzles 45 for ejecting a liquid and a plurality of pressure chambers 43 communicating with the corresponding ejection nozzles 45 and for storing an ink that is ejected from the ejection nozzles 45. The ejection nozzles 45 are arranged in a conveyance direction Y at a certain pitch and constitute four ejection orifice arrays 49 as shown in FIG. 2, and the pressure chambers 43 are correspondingly constitute four pressure chamber arrays 87 as shown in FIG. 3. On one end side of the flow path forming member 31 in the conveyance direction Y, four supply ports 40 are formed along the scanning direction X, and these four supply ports 40 are connected to the corresponding four ink cartridges 10*a*, 10*b*, 10*c*, 10*d* (see FIG. 1). The four ejection orifice arrays 49 communicate with the respective four supply ports 40 through common liquid chambers 41 described later, and each ejects a black ink, a yellow ink, a cyan ink, or a magenta ink. The structure of the flow path forming member 31 will be specifically described later.

The piezoelectric actuator 32 partly defines pressure chambers 43, and generates a pressure in each pressure chamber 43 for ejecting an ink in the pressure chamber 43 from an ejection nozzle 45 communicating with the pressure chamber 43. As shown in FIG. 4B, the piezoelectric actuator 32 includes a diaphragm 50 provided on the flow path forming member 31, a piezoelectric layer 51 provided on the diaphragm 50, and a plurality of individual electrodes 52 provided on the piezoelectric layer 51.

The diaphragm 50 is joined to the flow path forming member 31 so as to cover the pressure chambers 43. The diaphragm 50 is made from a metal material and also serves as a common electrode for generating an electric field in the thickness direction of the piezoelectric layer 51 between the diaphragm and the individual electrodes 52. The diaphragm 50 as the common electrode is connected to a ground wiring of a driver IC (not shown) and is constantly maintained at the ground potential. The piezoelectric layer 51 is made from a piezoelectric material mainly containing lead zirconate titanate (PZT) that is a strong dielectric and is a solid solution of lead titanate and lead zirconate, and is formed in a flat shape. The piezoelectric layer 51 is continuously formed over the pressure chambers 43 so as to face the pressure chambers 43. The individual electrodes 52 are placed on the piezoelectric layer 51 in regions opposite to the corresponding pressure chambers 43. As shown in FIG. 4A, each individual electrode 52 has substantially an elliptical planar shape slightly smaller than the pressure chamber 43, and faces the pressure chamber 43 at substantially the center of the pressure chamber 43 in a planar view. From ends of the individual electrodes 52, a plurality of contact members (not shown) are correspondingly pulled out along the longitudinal direction of the individual electrodes 52.

The contact members are connected to a flexible wiring board (not shown) that is connected to a main control substrate (not shown) of the recording apparatus 1 and includes a driver IC for driving the piezoelectric actuator 32. The driver IC is electrically connected through wirings in the flexible wiring board to the individual electrodes 52 and the common electrode (diaphragm) 50, and, in response to an order from the main control substrate, sends a drive pulse signal to each of the individual electrodes 52.

When a drive pulse signal is sent to an individual electrode 52, a certain drive voltage is applied to a part (active part) interposed between the individual electrode 52 on the piezoelectric layer 51 and the common electrode (diaphragm) 50, and an electric field in the thickness direction is generated. Hence, the active part contracts in the in-plane direction orthogonal to the thickness direction, and in accordance with the contraction, a part of the diaphragm 50 defining the pressure chamber 43 is deformed so as to project toward the inside of the pressure chamber 43. The pressure chamber 43 accordingly contracts to increase the pressure in the pressure chamber 43, and an ink in the pressure chamber 43 is ejected from an ejection nozzle 45.

Next, the detailed structure of the flow path forming member 31 will be described mainly with reference to FIG. 4B. The flow path forming member 31 includes eleven stacked plates 20 to 30. These include a cavity plate 20, a base plate 21, an aperture plate 22, a spacer plate 23, a first damper plate 24, and a second damper plate 25. These also include a first manifold plate 26, a second manifold plate 27, a cover plate 28, a third damper plate 29, and an ejection nozzle plate 30. These plates 20 to 30 are joined to each other with an adhesive. Each of the plates 20 to 29 of the plates 20 to 30 except the ejection nozzle plate 30 is a plate made from a metal material, such as a stainless steel plate and a nickel alloy steel plate, whereas the ejection nozzle plate 30 is a plate made from a synthetic resin material such as polyimide.

The flow path forming member 31 includes ejection nozzles 45 formed in the ejection nozzle plate 30 and pressure chambers 43 formed in the cavity plate 20. Each ejection nozzle 45 communicates with the corresponding pressure chamber 43 through a first communication flow path 44 formed through the plates 21 to 29. Each pressure chamber 43 communicates with a common liquid chamber 41 formed in the first and second manifold plates 26, 27 through a second communication flow path 46 including an aperture 42 formed through the plates 21 to 25. As shown in FIG. 2 and FIG. 3, each common liquid chamber 41 extends straightly in the conveyance direction Y and is provided for the corresponding pressure chamber array 87. Each common liquid chamber 41 communicates with the corresponding supply port 40 formed in the cavity plate 20 through a supply flow path (not shown) formed in the plates 21 to 25.

The flow path forming member 31 includes first and second damper chambers 47, 48 for damping a pressure change in the common liquid chamber 41. The first and second damper chambers 47, 48 are provided so as to interpose the common liquid chamber 41 therebetween in the stacking direction of the plates 20 to 30. The first and second damper chambers 47, 48 extend in the longitudinal direction (conveyance direction Y) of the common liquid chamber 41, and the first damper chamber 47 is placed so as to cover the common liquid chamber 41 in a planar view (see FIG. 3).

The first damper chamber 47 is a space containing air therein and is defined by the spacer plate 23, a through-hole 24*a* formed in the first damper plate 24, and a concave portion 25*a* formed on the second damper plate 25. A partition wall 25*c* between the first damper chamber 47 and the common liquid chamber 41 functions as a damper film deformable by a pressure change in the common liquid chamber 41, and thus the first damper chamber 47 can damp the pressure change. The planar shape of the first damper chamber 47 is an oval shape as shown in FIG. 3, but is not limited to the oval shape as long as a space is present therein and a partition wall 25*c* functions as a damper film.

In the first damper chamber 47, a plurality of supporting parts 70 are formed along the extending direction of the first damper chamber 47 (conveyance direction Y). Each supporting part 70 is composed of a convex portion 23*a* formed on the spacer plate 23 and a convex portion 25*b* formed in the concave portion 25*a* of the second damper plate 25. As shown in FIG. 3 and FIG. 4A, each supporting part 70 is provided for the corresponding pressure chamber 43 and functions to increase the rigidity of the pressure chamber 43. A preferred planar shape of the supporting part 70 for suppressing bending deformation of the pressure chamber 43 is exemplified by a shape along the longitudinal direction of the pressure chamber 43 as shown in FIG. 4A in order to achieve flexural rigidity. A preferred planar shape of the supporting part 70 when the pressure chamber 43 is torsionally deformed is exemplified by a shape along a diagonal direction of the rectangular pressure chamber 43 in order to achieve torsional rigidity.

Meanwhile, the second damper chamber 48 is a space containing air therein and is defined by a concave portion 29*b* formed on the third damper plate 29 and the cover plate 28. A part of the cover plate 28 between the second damper chamber 48 and the common liquid chamber 41 functions as a damper film deformable by a pressure change in the common liquid chamber 41, and thus the second damper chamber 48 can also damp the pressure change.

The flow path forming member 31 further has a liquid-repellent film 81 formed on the surface having the openings of the ejection nozzles 45 of the ejection nozzle plate 30, that is, on an ejection nozzle surface 30*a*, and has a plurality of projection parts 85 formed on a laminated body 82 including the third damper plate 29 and the ejection nozzle plate 30. The liquid-repellent film 81 is made from a fluorine resin and is provided in order to prevent an ink from adhering to the periphery of the ejection nozzles 45. The projection parts 85 project from the ejection nozzle surface 30*a* toward a recording paper 2 and are provided in order to prevent the recording paper 2 floated up by paper jam or the like from hitting and damaging the liquid-repellent film 81 around the ejection nozzles 45. As shown in FIG. 2, the projection parts 85 are arranged to form four projection part arrays 86 along the conveyance direction Y in regions overlapping with the corresponding four common liquid chambers 41, and are placed together with the four ejection orifice arrays 49 in parallel with the conveyance direction Y. By the projection parts 85 arranged in this manner, the periphery of the ejection nozzles 45 on the ejection nozzle surface 30*a* is protected against the recording paper 2 and is unlikely to come in contact with the recording paper 2, and thus the damage to the liquid-repellent film 81 can be effectively suppressed.

Each projection part 85 has a curved dome shape projecting in the direction from the third damper plate 29 to the ejection nozzle plate 30. The projection part 85 has a rounded tip, which suppresses the damage to the recording paper 2 even when the recording paper 2 hits the projection part 85. The height of the projection part 85 from the ejection nozzle surface 30*a* is preferably, for example, about 100 μm in order to certainly prevent the recording paper 2 from coming into contact with the periphery of the ejection nozzles 45.

The planar shape of the projection parts 85 is an elliptical shape having the major axis along the conveyance direction Y, as shown in FIG. 2. This is because the rolling direction of the third damper plate 29 that is a metal rolled plate is the conveyance direction Y. In other words, the metal material is likely to spread in the rolling direction of the third damper plate 29 when the third damper plate 29 (together with the ejection nozzle plate 30) is plastically deformed by press working with a punch to form projection parts 85, as described later. The planar shape of the projection parts 85 is not limited to the elliptical shape, and projection parts 85 having various planar shapes can be formed by changing the shape of a punch or a die. Depending on material properties (for example, ductility) of a third damper plate 29, the plastic deformation of the third damper plate 29 may not lean to a specific direction. In the case, a cylinder-shaped punch can also be used to form projection parts 85 having substantially a circular planar shape.

As described above, the projection parts 85 are formed by joining the third damper plate 29 made from a metal material to the ejection nozzle plate 30 made from a resin material and then press working of the plates. However, the internal stress generated during the press working can form a clearance between the joined plates 29, 30, and into the clearance, water (moisture) can enter from the outside through the ejection nozzle plate 30 during subsequent production steps. When these two plates 29, 30 in such a condition are thermally joined to other plates 20 to 28 included in the flow path forming member 31, the water infiltrated into the clearance may expand to release the third damper plate 29 from the ejection nozzle plate 30, unfortunately.

In the present embodiment, a plurality of through-slits 80 are formed adjacent to the projection parts 85 as shown in FIG. 2 to FIG. 4 in order to relax the internal stress associated with such press working. The through-slits 80 are formed through the third damper plate 29, extend along the conveyance direction (the array direction of ejection nozzles 45) Y, and are arranged so as to interpose the projection parts 85 therebetween from both sides in the scanning direction X orthogonal to the conveyance direction Y. The through-slits 80 not only relax the internal stress generated at the time of the production of a liquid ejection head 3 but also can relax a stress generated by thermal expansion or the like at the time of use of a completed liquid ejection head 3, as described later. In the example shown in figures, the through-slits 80 are arranged at both sides of the projection parts 85 in the scanning direction X, but may be arranged at one side, and the internal stress can be relaxed in such a case.

Next, a method for producing a liquid ejection head of the embodiment will be described with reference to FIG. 5. Specifically, a process of producing a flow path forming member will be described. FIG. 5 are schematic cross-sectional views of a liquid ejection head in production steps of a flow path forming member in the embodiment.

Figure 5A:
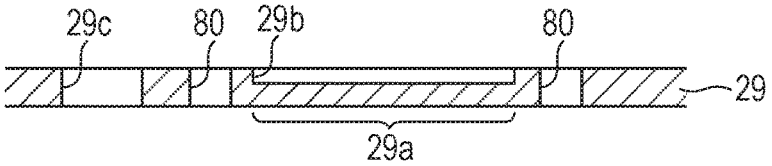
FIGS. 5A, 5B, 5C, 5D, 5E and 5F are schematic cross-sectional views showing a method for producing a liquid ejection head pertaining to the first embodiment.

First, a third damper plate 29 made from a metal material is prepared and is subjected to half etching to form concave portions 29*b* to be second damper chambers 48 in the third damper plate 29, forming thin-wall parts 29*a*, as shown in FIG. 5A. Laser machining, photolithography, or punching is further performed to form a plurality of through-holes 29*c* to be first communication flow paths 44 and to form a plurality of through-slits 80 at positions adjacent to the thin-wall parts 29*a*.

Figure 5B:
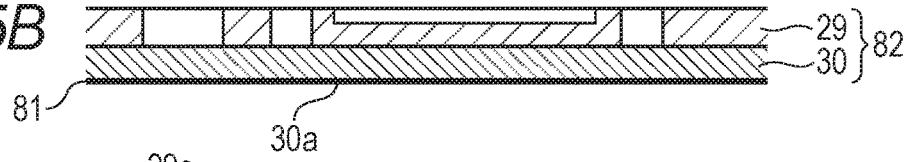

As shown in FIG. 5B, an ejection nozzle plate 30 made from a resin material and having a liquid-repellent film 81 on one surface to be an ejection nozzle surface 30*a* is prepared, and the other surface of the ejection nozzle plate 30 is stacked on and joined to the third damper plate 29. Specifically, an adhesive is interposed between the ejection nozzle plate 30 and the third damper plate 29, and the two plates 29, 30 are pressed and joined, thereby forming a laminated body 82 including the two plates 29, 30.

The liquid-repellent film 81 can be formed by attaching a fluorine resin film to the ejection nozzle plate 30 or by applying a liquid fluorine resin to the ejection nozzle plate 30.

Figure 5C:
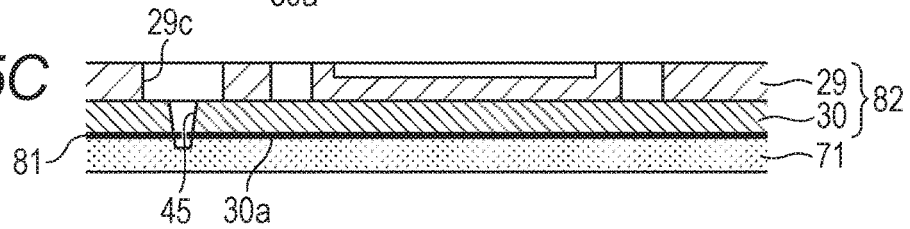

As shown in FIG. 5C, to the surface 30*a* with the liquid-repellent film 81 of the ejection nozzle plate 30, a protective film 71 made from a synthetic resin film is attached and bonded by using a UV releasable adhesive, for example. Next, the ejection nozzle plate 30 of the laminated body 82 is subjected to laser machining to form a plurality of ejection nozzles 45 at regions of the ejection nozzle plate 30 facing the through-holes 29*c*.

Figure 5D:
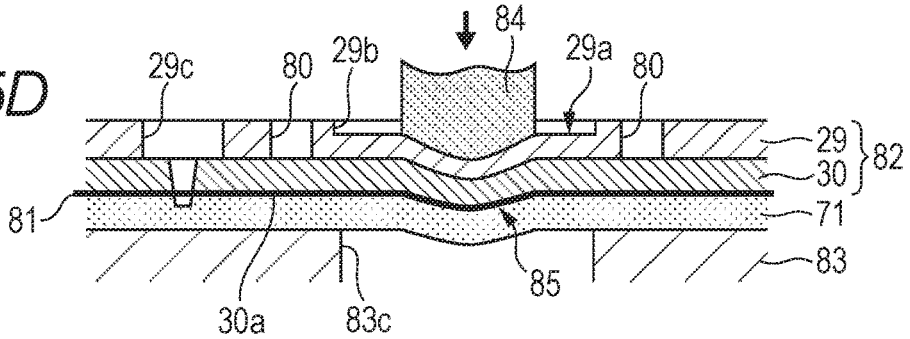

As shown in FIG. 5D, the laminated body 82 is subjected to press working to form a plurality of projection parts 85. Specifically, the laminated body 82 with the protective film 71 on the bottom surface 30*a* is placed on a die 83 having a plurality of holes 83*c*. Here, the laminated body 82 is placed so that the thin-wall parts 29*a* of the third damper plate 29 cover the holes 83*c* of the die 83. Next, a punch 84 is brought into contact with each thin-wall part 29*a* of the third damper plate 29, and the tapered tip of the punch 84 is pushed from the third damper plate 29 toward the ejection nozzle plate 30 to perform press working. In this manner, the third damper plate 29 is plastically deformed, and the laminated body 82 is partially curved and projected downwardly, thereby forming a plurality of dome-shaped projection parts 85 projecting from the bottom surface 30*a* of the ejection nozzle plate 30.

During the deformation, although an internal stress is generated in the third damper plate 29 by press working as described above, the internal stress can be relaxed by the through-slits 80 formed adjacent to the thin-wall parts 29*a* of the third damper plate 29 in the present embodiment. Such a structure can prevent a clearance from forming between the third damper plate 29 and the ejection nozzle plate 30 by the internal stress generated during press working. In order to more effectively relax the internal stress by press working, through-slits 80 are preferably arranged symmetrically at both sides of the thin-wall parts 29*a* in a direction orthogonal to the array direction of ejection nozzles 45 (horizontal direction in the figures).

During the press working, the bottom surface 30*a* of the ejection nozzle plate 30 is covered with the protective film 71 and does not come in contact with the die 83, and thus the liquid-repellent film 81 formed on the bottom surface 30*a* of the ejection nozzle plate 30 is also prevented from being damaged.

Figure 5E:
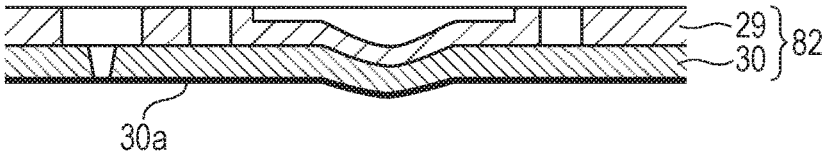

As shown in FIG. 5E, the protective film 71 is released from the bottom surface 30*a* of the ejection nozzle plate 30. For example, when the protective film 71 is joined to the ejection nozzle plate 30 with an UV releasable adhesive, the protective film 71 can be easily released by UV irradiation. Depending on the type of a protective film 71, a protective film 71 can be dissolved in an appropriate solvent to be removed.

Figure 5F:
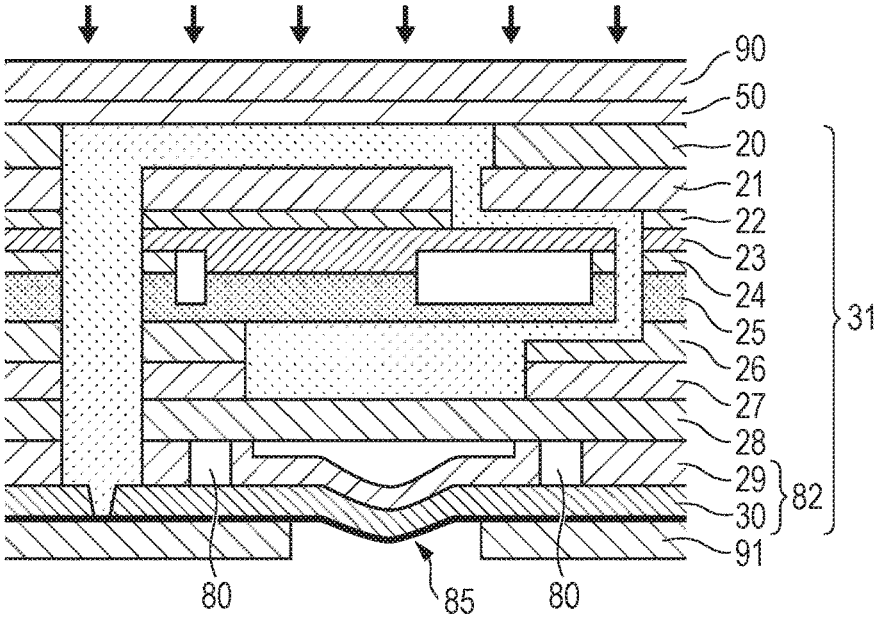

As shown in FIG. 5F, a joining step is performed to join the laminated body 82, the other plates 20 to 28 constituting a flow path forming member 31, and a diaphragm 50 of a piezoelectric actuator 32. In the other plates 20 to 28 constituting the flow path forming member 31, through-holes to be pressure chambers 43, common liquid chambers 41, first communication flow paths 44, and the like are previously formed by etching. In the joining step, a thermosetting adhesive is applied onto each joint surface of the laminated body 82, the plates 20 to 28, and the diaphragm 50, then the members are stacked on each other, and the whole is pressed in the vertical direction while heated at, for example, 150° C. by heater plates 90, 91. In this manner, the laminated body 82, the plates 20 to 28, and the diaphragm 50 are joined. In order to prevent the projection parts 85 of the laminated body 82 from being crushed, the lower heater plate 91 preferably has recesses having such a shape as not to come in contact with the projection parts 85, for example, a concave shape or a hole shape, as shown in the figure.

Next, a piezoelectric layer 51 prepared in a separate step is attached onto the diaphragm 50, then a plurality of individual electrodes 52 are formed on the piezoelectric layer 51 to form a piezoelectric actuator 32, and the liquid ejection head 3 shown in FIG. 2 to FIG. 4 is completed.

In the above joining step, the cover plate 28 is joined to the third damper plate 29, thereby forming a plurality of spaces of the through-slits 80. The through-slits 80 therefore relax the internal stress generated at the time of the production of a liquid ejection head 3. In addition, the spaces formed in the completed liquid ejection head 3 can also relax a stress generated by thermal expansion or the like at the time of use. From these viewpoints, the through-slits 80 may be filled with, for example, a resin having a small coefficient of cubical expansion to suppress thermal expansion.

Second Embodiment

Figure 6A:
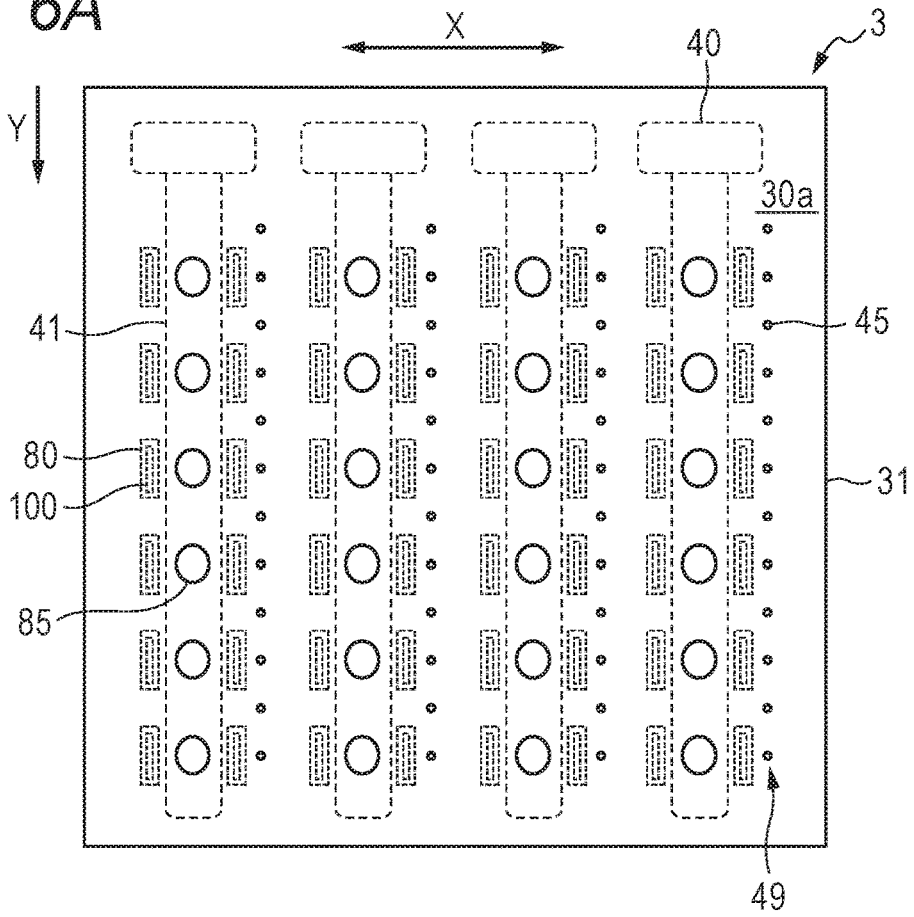
FIGS. 6A and 6B are a schematic plan view and a cross-sectional view of a liquid ejection head pertaining to a second embodiment.
Figure 6B:
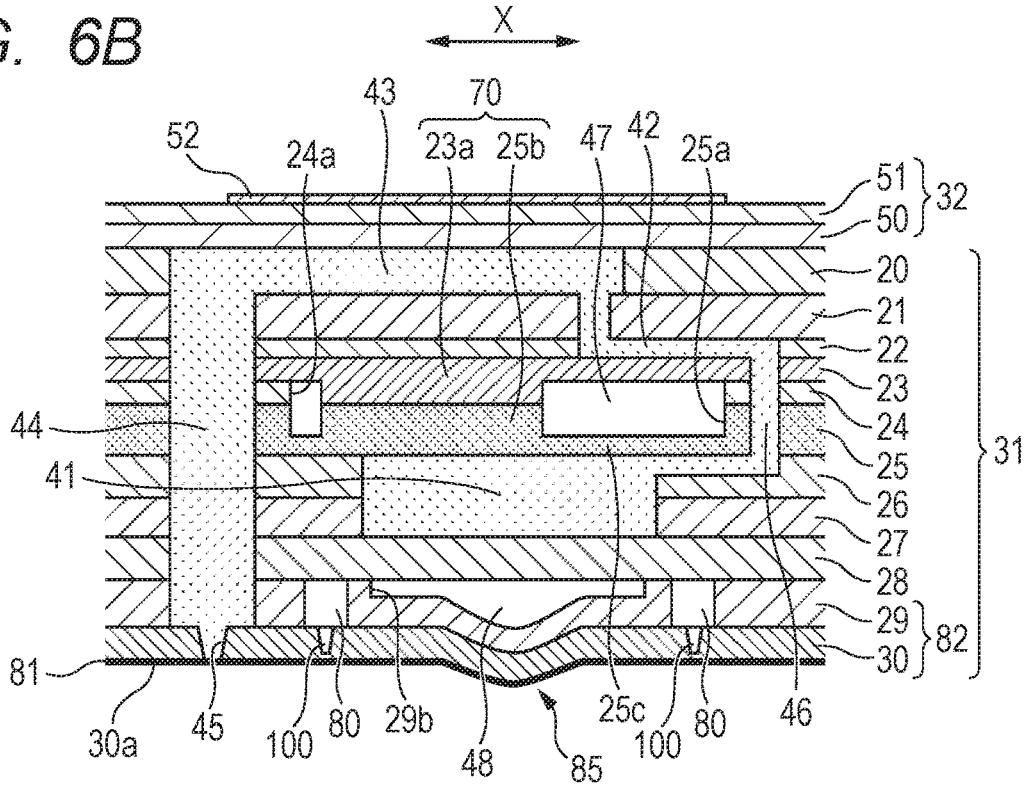

FIG. 6A is a schematic plan view of a liquid ejection head pertaining to a second embodiment of the present invention, viewed from the ejection nozzle surface side. FIG. 6B is a schematic cross-sectional view of the liquid ejection head of the embodiment. The present embodiment is the same as the first embodiment except that a plurality of concave portions 100 are added to the first embodiment.

A plurality of concave portions 100 are formed on a surface of an ejection nozzle plate 30 facing a third damper plate 29 in addition to a plurality of through-slits 80 in order to relax the internal stress generated at the time of production of a liquid ejection head 3. The concave portions 100 are arranged so as to interpose projection parts 85 therebetween from both sides in a scanning direction X, at positions facing the through-slits 80.

Figure 7A:
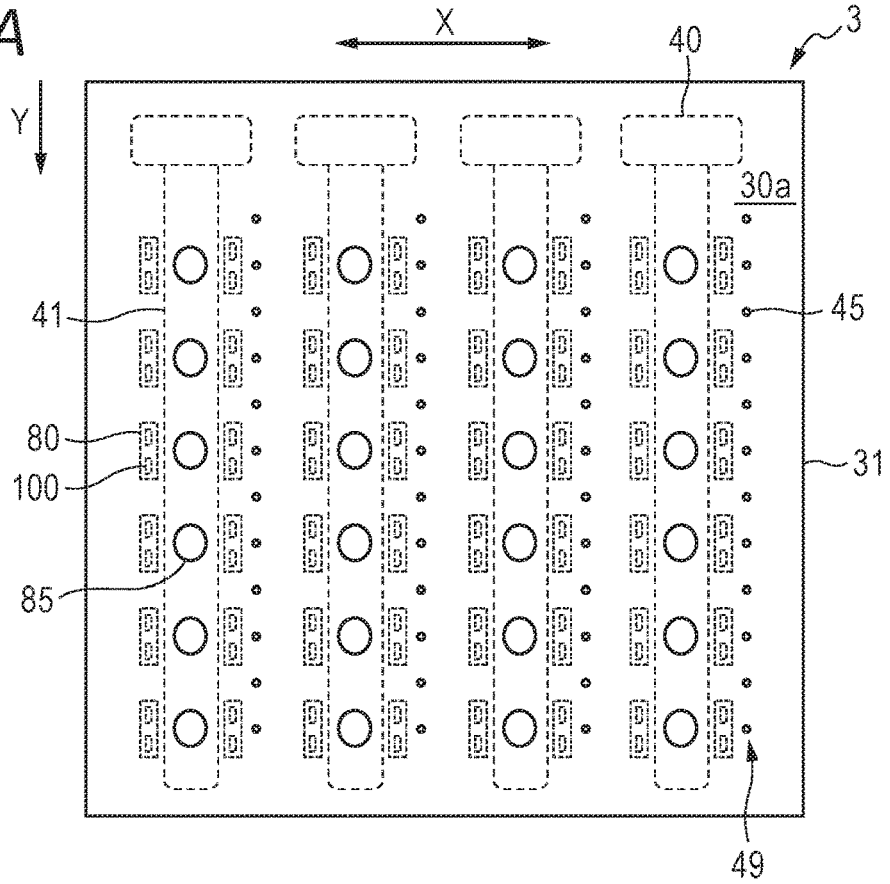
FIGS. 7A and 7B are schematic plan views showing alternative liquid ejection heads pertaining to the second embodiment.
Figure 7B:
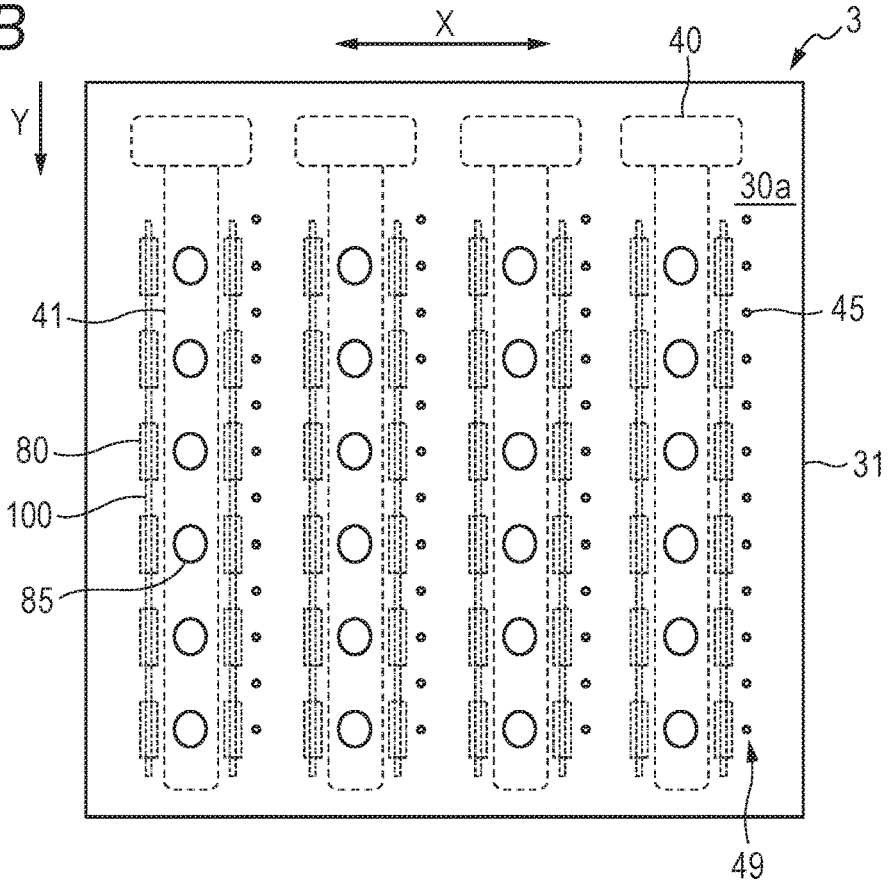

In the example shown in FIG. 6A, each concave portion 100 is formed inside the corresponding through-slit 80 viewed from the stacking direction of a laminated body 82, but the position of the concave portion 100 is not limited to this. For example, as shown in FIG. 7A, two concave portions 100 may be formed inside the corresponding through-slit 80, or three or more concave portions may be formed. As shown in FIG. 7B, a concave portion 100 may be continuously formed over a plurality of through-slits 80 in the conveyance direction Y.

Figure 8A:
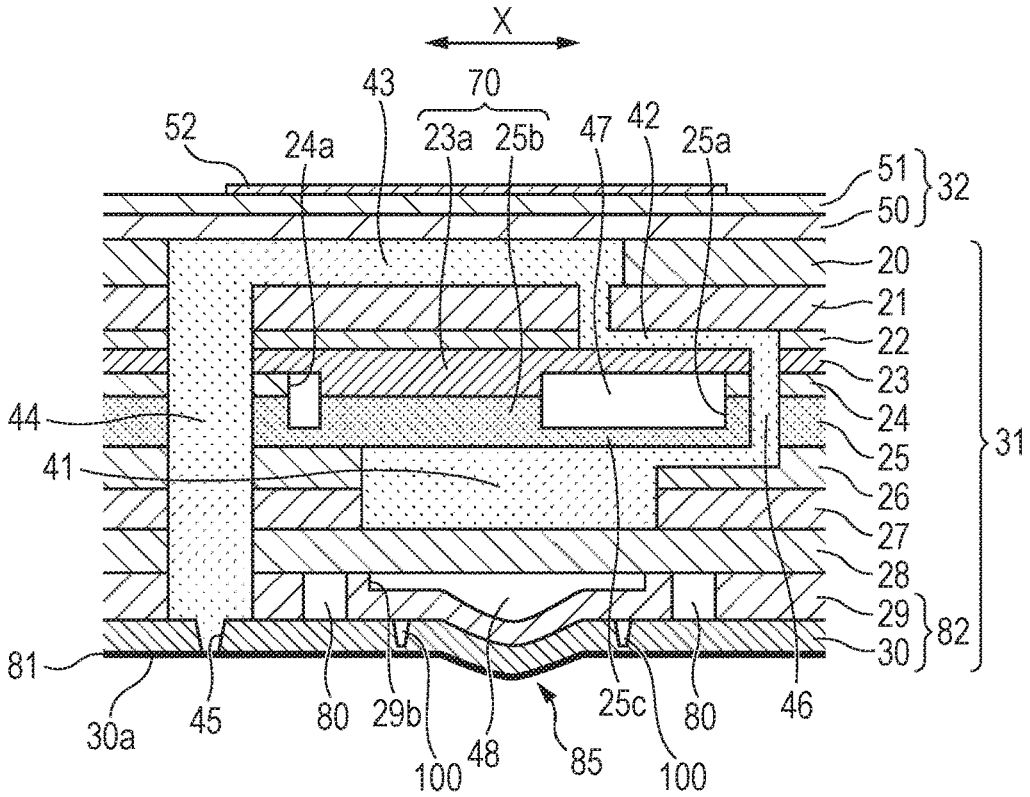
FIGS. 8A and 8B are schematic cross-sectional views showing alternative liquid ejection heads pertaining to the second embodiment.
Figure 8B:
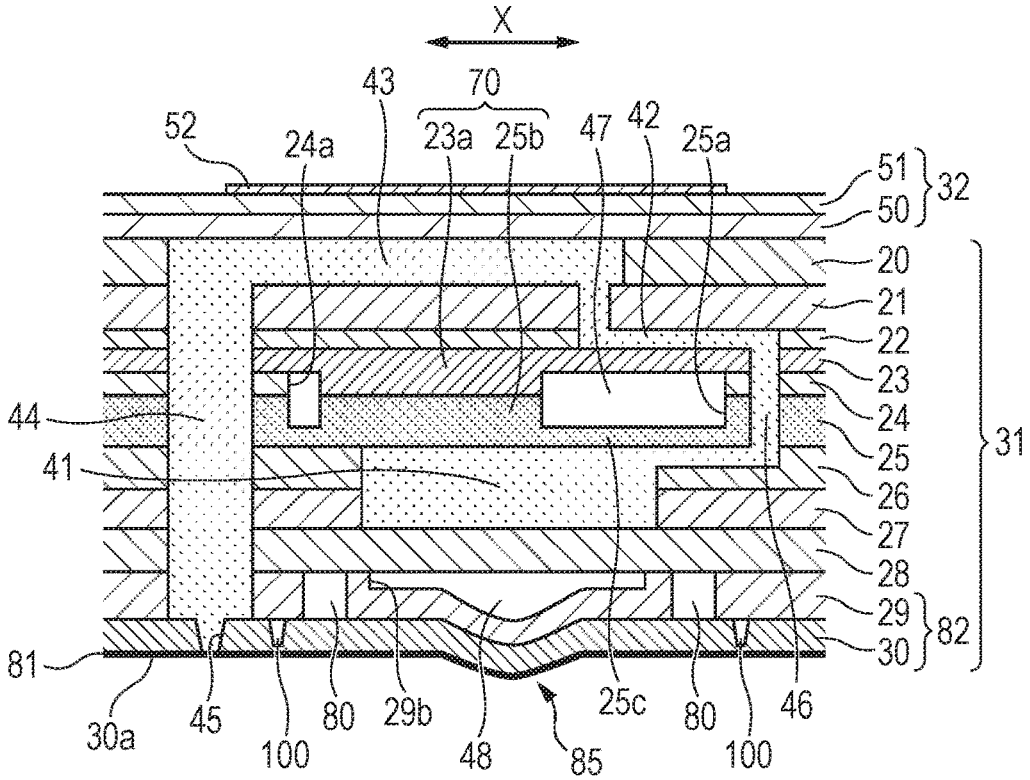

The formation position of each concave portion 100 in the scanning direction X is also not limited to the position facing the corresponding through-slit 80. For example, as shown in FIG. 8A, the position may be closer to the projection part 85 than the through-slit 80, or as shown in FIG. 8B, the position may be farther from the projection part 85 than the through-slit 80. Also in such a case, the concave portions 100 may be discretely arranged in the conveyance direction Y as with the cases in FIG. 6A and FIG. 7A, or may be continuously arranged as with the case in FIG. 7B.

In the embodiment, the concave portions 100 can be formed, in the cases of FIG. 6A and FIG. 7A, by laser machining though through-slits 80 concurrently with the step of forming ejection nozzles 45 (see FIG. 5C). In the other cases, the concave portions 100 can be formed by laser machining or photolithography before the step of joining an ejection nozzle plate 30 to a third damper plate 29 (see FIG. 5B).

Third Embodiment

Figure 9:
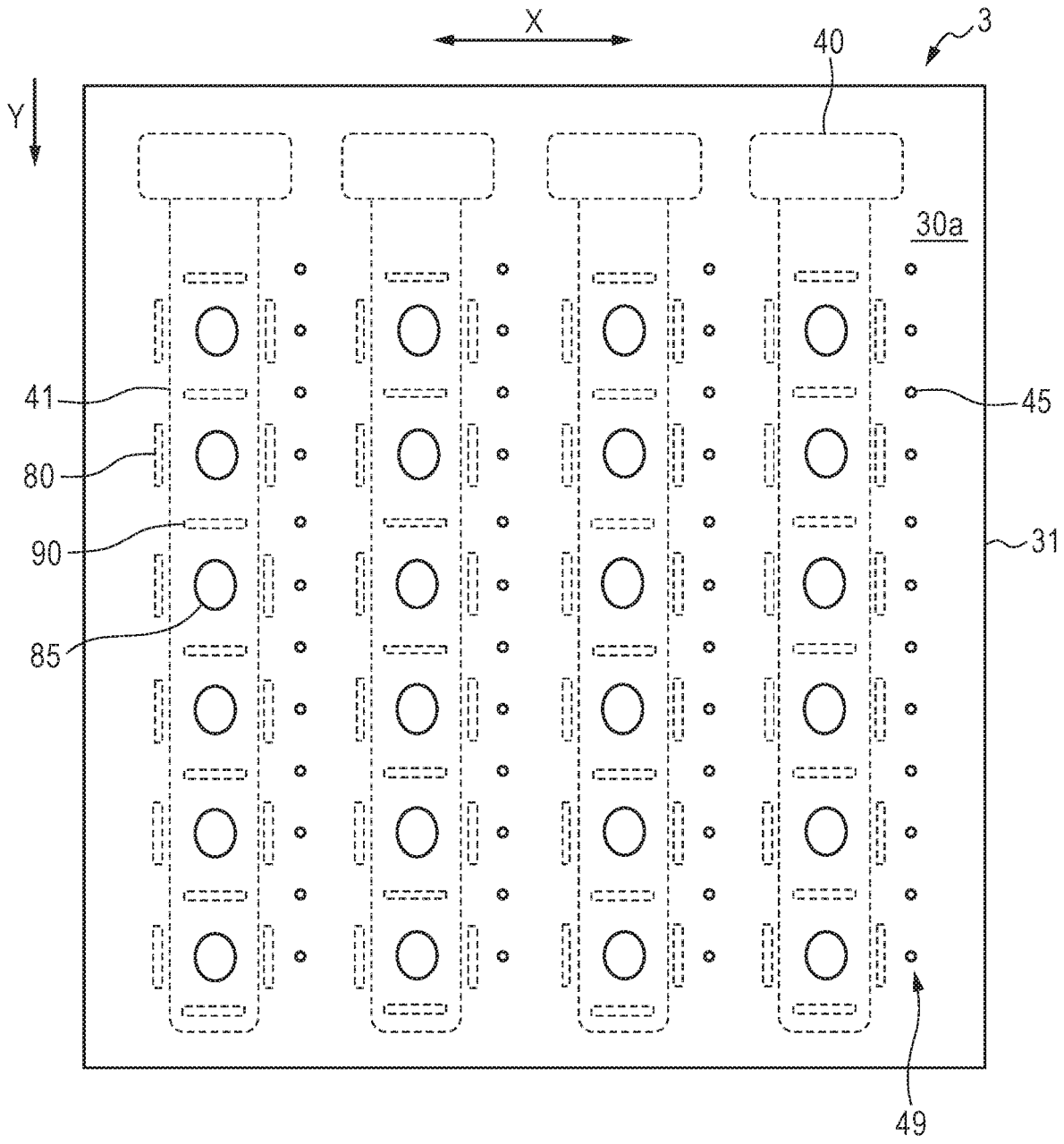
FIG. 9 is a schematic plan view of a liquid ejection head pertaining to a third embodiment.

FIG. 9 is a schematic plan view of a liquid ejection head pertaining to a third embodiment of the present invention, viewed from the ejection nozzle surface side. In the present embodiment, a plurality of additional through-slits (second through-slits) 90 are further provided in a third damper plate 29 in addition to the through-slits (first through-slits) 80 in the above embodiments. The figure shows a case in which a plurality of second through-slits 90 are added to the first embodiment, but second through-slits can also be added to the second embodiment in which a plurality of concave portions 100 are provided.

The second through-slits 90 extend in a scanning direction X and are arranged so as to interpose projection parts 85 therebetween from both sides in a conveyance direction Y. The second through-slits 90 are also preferably arranged symmetrically at both sides of the projection parts 85 in the conveyance direction Y in order to effectively relax an internal stress. The second through-slits 90 can also be formed by laser machining, photolithography, or punching as with the step of forming first through-slits 80 (see FIG. 5A).

According to the present invention, an internal stress generated at the time of production can be relaxed to achieve high reliability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A liquid ejection head comprising:

a laminated body including a first plate having a plurality of ejection nozzles configured to eject a liquid and a second plate having a plurality of through-holes communicating with the corresponding ejection nozzles, the laminated body having a plurality of projection parts formed along an array direction of the ejection nozzles and curved to project in a direction from the second plate to the first plate;

a communication flow path; and a piezoelectric actuator that generates pressure for ejecting the liquid from the ejection nozzles, wherein the second plate has a plurality of through-slits penetrating the second plate separately from the communication flow path, and wherein the through-slits formed adjacent to the projection parts have a longer side and a shorter side when the second plate is viewed from an ejection nozzle surface side.

2. The liquid ejection head according to claim 1, wherein the through-slits include a plurality of first through-slits having the longer side extending along the array direction and arranged at both sides of the projection parts in a direction orthogonal to the array direction.

3. The liquid ejection head according to claim 2, wherein the first plate has a plurality of concave portions that are formed on a joining surface of the first plate to the second plate and are arranged to interpose the projection parts therebetween in the direction orthogonal to the array direction.

4. The liquid ejection head according to claim 3, wherein each of the concave portions is arranged at a position facing the first through-slit.

5. The liquid ejection head according to claim 4, wherein the concave portions are formed discretely in the array direction.

6. The liquid ejection head according to claim 4, wherein the concave portions are formed continuously in the array direction.

7. The liquid ejection head according to claim 3, wherein each of the concave portions is arranged at a position closer to the projection part than the first through-slit in the direction orthogonal to the array direction.

8. The liquid ejection head according to claim 3, wherein each of the concave portions is arranged at a position farther from the projection part than the first through-slit in the direction orthogonal to the array direction.

9. The liquid ejection head according to claim 2, wherein the through-slits have a rectangle shape when the second plate is viewed from the ejection nozzle surface side.

10. The liquid ejection head according to claim 2, wherein the through-slits are arranged adjacent to each of the ejection nozzles in the direction orthogonal to the array direction.

11. The liquid ejection head according to claim 1, wherein each of the projection parts has a dome shape.

12. The liquid ejection head according to claim 1, wherein the through-slits extend in a direction orthogonal to the array direction.

13. The liquid ejection head according to claim 1, wherein the through-slits have a rectangle shape when the second plate is viewed from the ejection nozzle surface side.

14. The liquid ejection head according to claim 1, wherein when the second plate is viewed from the ejection nozzle surface side, the second plate has concave portions at an overlapping portion with the projection parts, and second through-slits are formed at both sides of the concave portions in a direction orthogonal to the array direction.

15. The liquid ejection head according to claim 1, wherein one of the ejection nozzles, one of the through-slits, and one of the projection parts are arranged adjacently in this order in a direction intersecting with the array direction.

16. The liquid ejection head according to claim 1, wherein the through-slits include a plurality of second through-slits at both sides of the projection parts in the array direction.

17. The liquid ejection head according to claim 16, wherein the projection parts have an elliptical shape having a long axis in the array direction of the ejection nozzles when the first plate is viewed from the ejection nozzle surface side.

18. The liquid ejection head according to claim 1, wherein a height of the projection parts from an ejection nozzle surface is 100 μm.

19. The liquid ejection head according to claim 1, wherein the projection parts have an elliptical shape when the first plate is viewed from the ejection nozzle surface side.

* * * * *